United States Patent [19]

Firth et al.

[11] 4,048,906

[45] Sept. 20, 1977

[54] LOW-STRESS CAM-DRIVEN PISTON MACHINES

[75] Inventors: Donald Firth; Sinclair Upton Cunningham, both of Glasgow, Scotland

[73] Assignee: National Research Development Corporation, London, England

[21] Appl. No.: 808,536

[22] Filed: Mar. 19, 1969

[30] Foreign Application Priority Data

Mar. 22, 1968 United Kingdom ..... 14082/68

[51] Int. Cl.[2] ..... F01B 13/06

[52] U.S. Cl. ..... 91/491

[58] Field of Search ..... 103/162, 213; 91/198–205; 92/57; 230/177; 74/55

[56] References Cited

U.S. PATENT DOCUMENTS

| | | | |
|---|---|---|---|
| 1,723,874 | 8/1929 | Lunge | 103/213 |
| 1,766,610 | 6/1930 | Davis | 103/213 |
| 2,882,831 | 4/1959 | Dannevig | 103/161 |
| 2,992,619 | 7/1961 | Nilges | 103/162 |
| 3,046,950 | 7/1962 | Smith | 103/174 |
| 3,151,529 | 10/1964 | Leath | 91/202 |

FOREIGN PATENT DOCUMENTS

| | | | |
|---|---|---|---|
| 336 | 1/1912 | United Kingdom | 103/161 |

OTHER PUBLICATIONS

Selection of the Track, Profile for A Radial-Piston High-Torque Hydraulic Motor by Yu F. Ponamarento, published in Russian Journal, Dec. 1961.

*Primary Examiner*—William L. Freeh

*Attorney, Agent, or Firm*—Cushman, Darby & Cushman

[57] ABSTRACT

A hydrostatic piston-and-cylinder machine includes an array of cylinders and a piston movable in each cylinder, a sinuous cam track and a cam-follower associated with the pistons engaging the cam track in a manner such that the pistons move to and fro along the axes of their cylinders on movement of the cylinder array along the cam track. For the relief of stresses due to high mutual convexity of the cam and cam follower the cam is shaped to give a relatively low velocity change rate for the pistons along the cylinder bores when the cam follower is negotiating the crests of the cam and a relatively high velocity change rate when the cam follower is negotiating the troughs of the cam.

7 Claims, 10 Drawing Figures

VELOCITY
+
0
-
1
2
3
4
5
6
7
8
9
10
11
12
13
14
15
16
17
18
19
20

40
38
48
45
44
46
40'
37
49
39
47
41
41'
40''
35
36
36'
42
43
BALL NO.
1
2
3
4
5
6
7
8
+
0
-

1-4ℓ/n i.e. X=2
1-82/n i.e. X=4
5
9
4
8
3
7
2
56
6
57
58
59
60
56'
62
61
1
2
3
4
5
6
7
8
9

62
64
69
70
22
11
71
60
61
63
69
73
74
66
72
68
67
55

LOW-STRESS CAM-DRIVEN PISTON MACHINES

BACKGROUND OF THE INVENTION

This invention relates to hydrostatic piston-and-cylinder machines, which may be pumps or motors. More specifically it relates to machines of this type in which the pistons are constrained to move along their respective cylinders by means of a cam having a sinuous track which is followed by a cam follower of circular profile. A common form for such machines uses a ball for each piston, the ball also acting as the cam follower but sometimes the ball is backed by a sealing element of cylindrical form which is constrained to move up and down the cylinder with the ball; sometimes again the piston is cylindrical in form and has a cam follower wheel mounted for rotation in a yoke in the end of the piston. The invention includes these variants within its scope but for convenience it will be described hereafter in relation to the ball-piston form of these machines.

These machines may be of the rotational type, as shown for instance in the specification of French Pat. No. 1,456,704, with the cylinders arranged radially and the pistons caused to stroke in the cylinders by a peripheral or an internal circular cam. Alternatively the cylinders may be arrayed with their axes in a cylindrical surface, as shown for instance in the specification of U.S. Pat. No. 2,617,360 with the pistons engaging the edge of an arcuate cam; in this form the cylinder block may embrace a relatively small part of the total circumference of the cam and there may be no provision for continuous rotation. Alternatively again the cylinder axes may lie in a plane with the pistons engaging a linear cam to provide a linear hydrostatic actuator or pump as shown in the specification of United Kingdom Pat. No. 961339. All these variants also are within the scope of the invention, but for convenience it will be described in relation to a machine with radial cylinders, and pistons engaging an external cam surrounding the cylinder block, the machine being adapted for continuous rotation.

The cam profile may have one or more complete lobes accommodated within the complete 360° circumference. A lobe provides for one complete to and fro excursion of each piston in its cylinder. Each lobe has two half-lobes each causing the piston to make a stroke in one direction. Alternate half-lobes produce strokes of the pistons alternately in different directions.

As with all machines where hardened bodies are in rolling contact and subjected to high loading, the inter-engaging surfaces are subjected to high Hertzian stresses, and these stresses are enhanced where there is high mutual convexity as compared with the case where there is a "wrap-round" effect, the outer race of a ball bearing for instance.

In the case of machines according to the invention these stresses are enhanced in the cam crest regions as compared with the cam trough regions. It is therefore advantageous to have as large a radius of curvature as possible in these regions of the cam, even at the expense of a substantially smaller radius of curvature at the trough regions because the increased wrap-round effect increases the size of the effective contact patch between the ball piston and the cam track, for any given normal loading, so long as this is not carried to the point where unacceptable accelerations would be imposed on the ball pistons in traversing the trough regions of the cam.

It is convenient to describe the cam profile in terms of the curves of motion which it imposes upon the ball pistons, more specifically curves in which the velocity of a reference point on the piston is represented by the vertical axis and progress of the piston along the cam track by the horizontal axis (which, for a given constant speed of such progress, can be regarded as representing time). For each stroke of a piston the curve will rise from zero to a maximum velocity from which it must fall to zero again before the end of the stroke. The elementary form of this curve is an isosceles triangle representing constant acceleration followed by constant deceleration, at the same rate.

Since time x velocity = distance, it follows that the area beneath such a curve, for a stroke of the piston, represents the length of the stroke. Therefore in comparing similar machines having different stroke velocity regimes the different curves must have their velocity values adjusted to bring the areas under the curves into equality.

SUMMARY OF THE INVENTION

According to the invention a hydrostatic piston-and-cylinder machine, in which cam following elements of, or carried by, the pistons are caused to traverse a sinuous cam track which causes the pistons to move to and fro along the axes of their cylinders, has a shape for the cam track such as to impose on the pistons a relatively low rate of change of velocity when the cam follower element, (which is the piston itself when the pistons take the form of balls), is traversing the crest, or crests, in a multi-lobe cam track, of the cam profile and a relatively high rate of change of velocity when the cam follower element is traversing the trough (or troughs) of the cam profile.

In general the cam only acts on a piston in one direction, namely towards the head of the cylinder, and it is in practice usually unnecessary to provide a double-acting cam since during the power stroke in the case of a motor, the pressure of the working fluid urges the piston against the cam or in the case of a pump the piston is subjected during the induction stroke, to a finite pressure commonly known as a "boost" pressure.

The power stroke of a motor starts with the cam follower on the centre of a crest of a cam and ends when the cam follower has reached the centre of a trough of the cam. Working fluid at high pressure enters the cylinder during this period and the highest Hertzian stresses occur near the beginning of this stroke. During the ensuing period the cam forces the piston back into the cylinder to execute an exhaust stroke which begins at the centre of a trough of the cam and ends at the centre of the next crest of the cam, working fluid being expelled from the cylinder, generally against a boost pressure which is not high enough to produce high stresses at the inter-engaging cam and cam follower surfaces.

If the same machine is to be used as a pump, without changing the direction of rotation the high pressure and low pressure lines are changed over and what was the exhaust stroke of the motor becomes the pumping stroke of the pump during which the pressure in the cylinder is high and the highest Hertzian stresses occur near the end of the stroke when the cam follower is negotiating the crest of the cam up to the centre of that crest.

If the machine, be it pump or motor, is reversed in direction of rotation, the two half-lobes of each lobe of the cam have their functions interchanged.

DETAILED DESCRIPTION

Figures 1A, 1B, 1C:
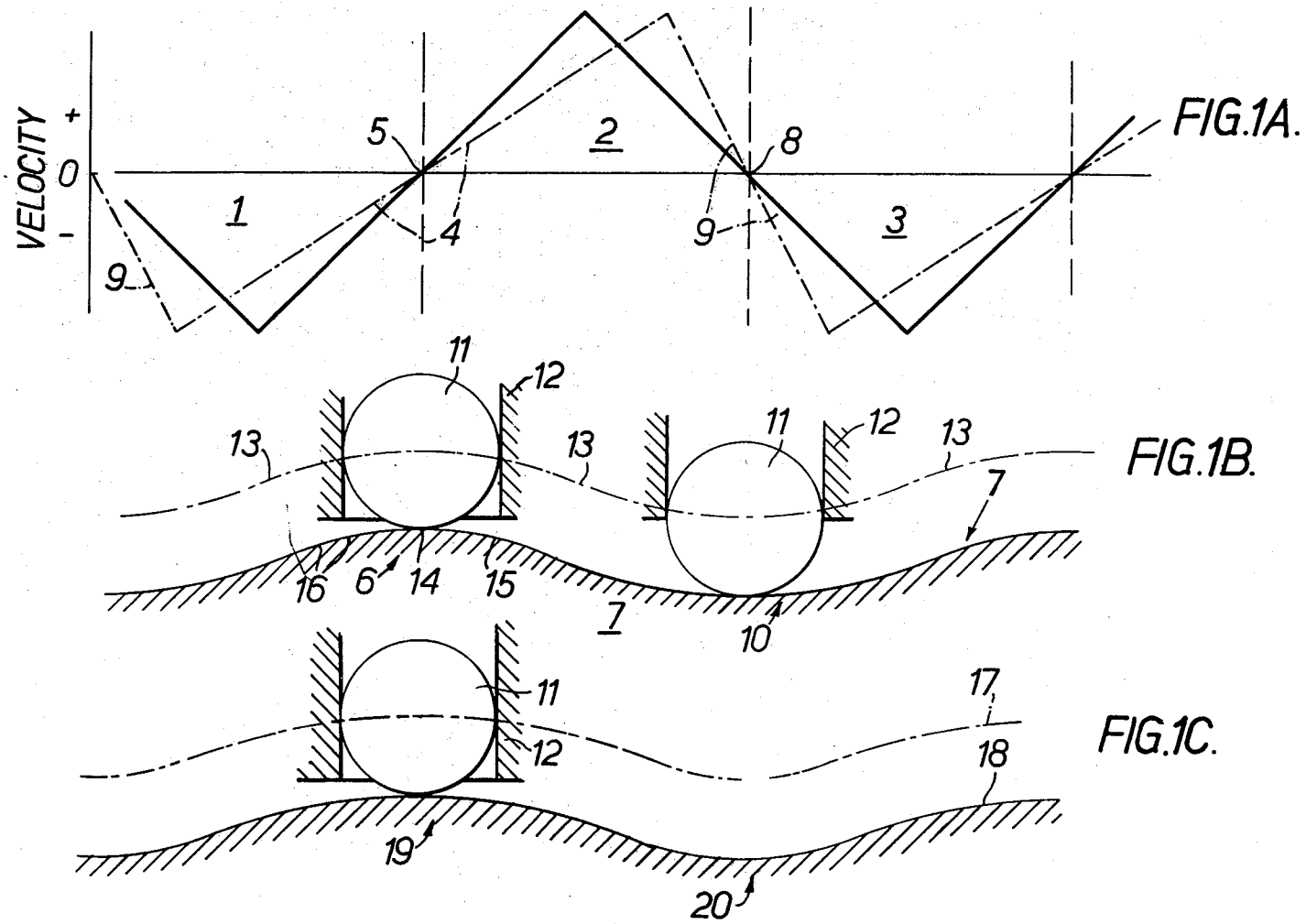
Figure 2:
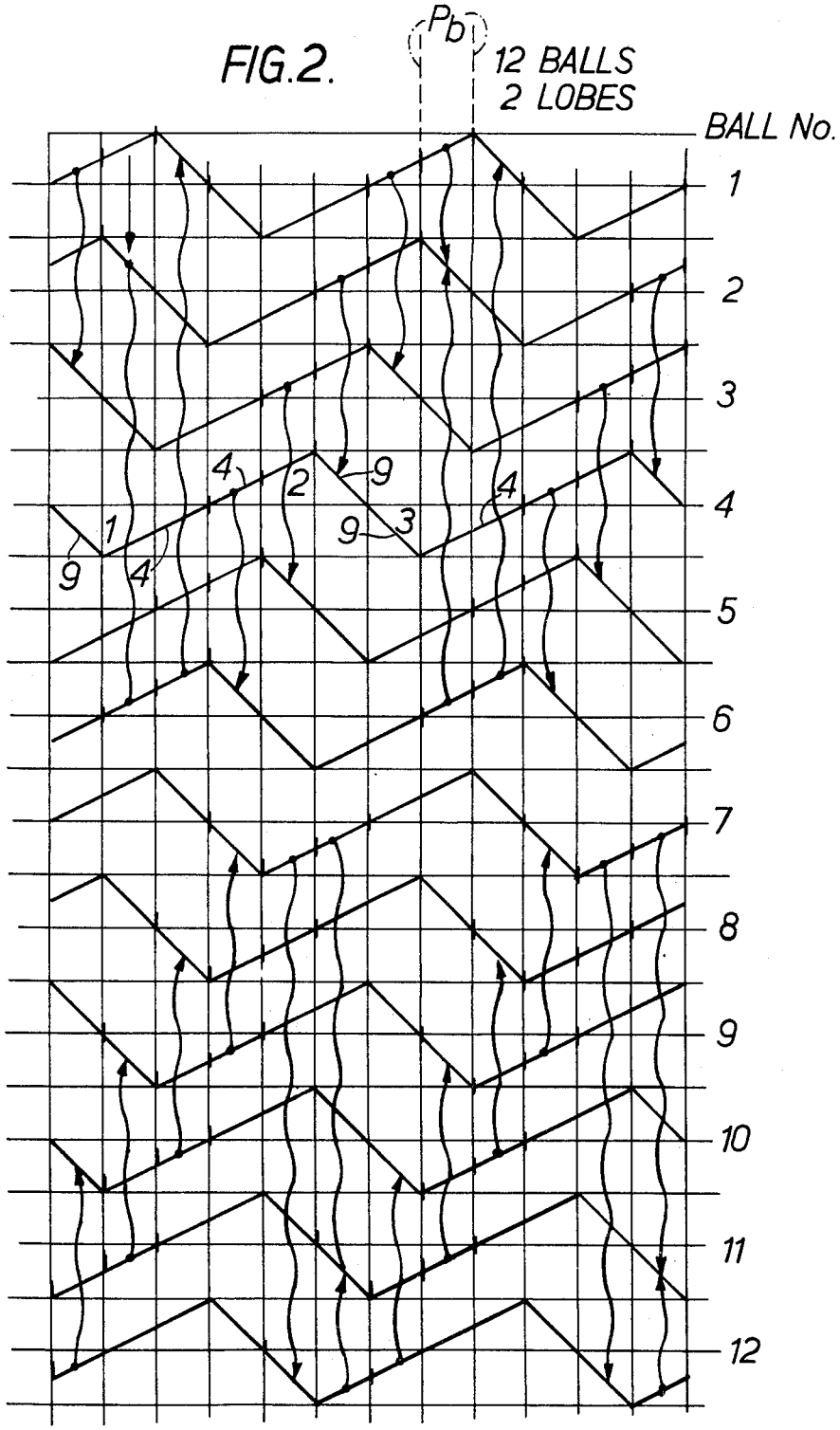
Figure 3:
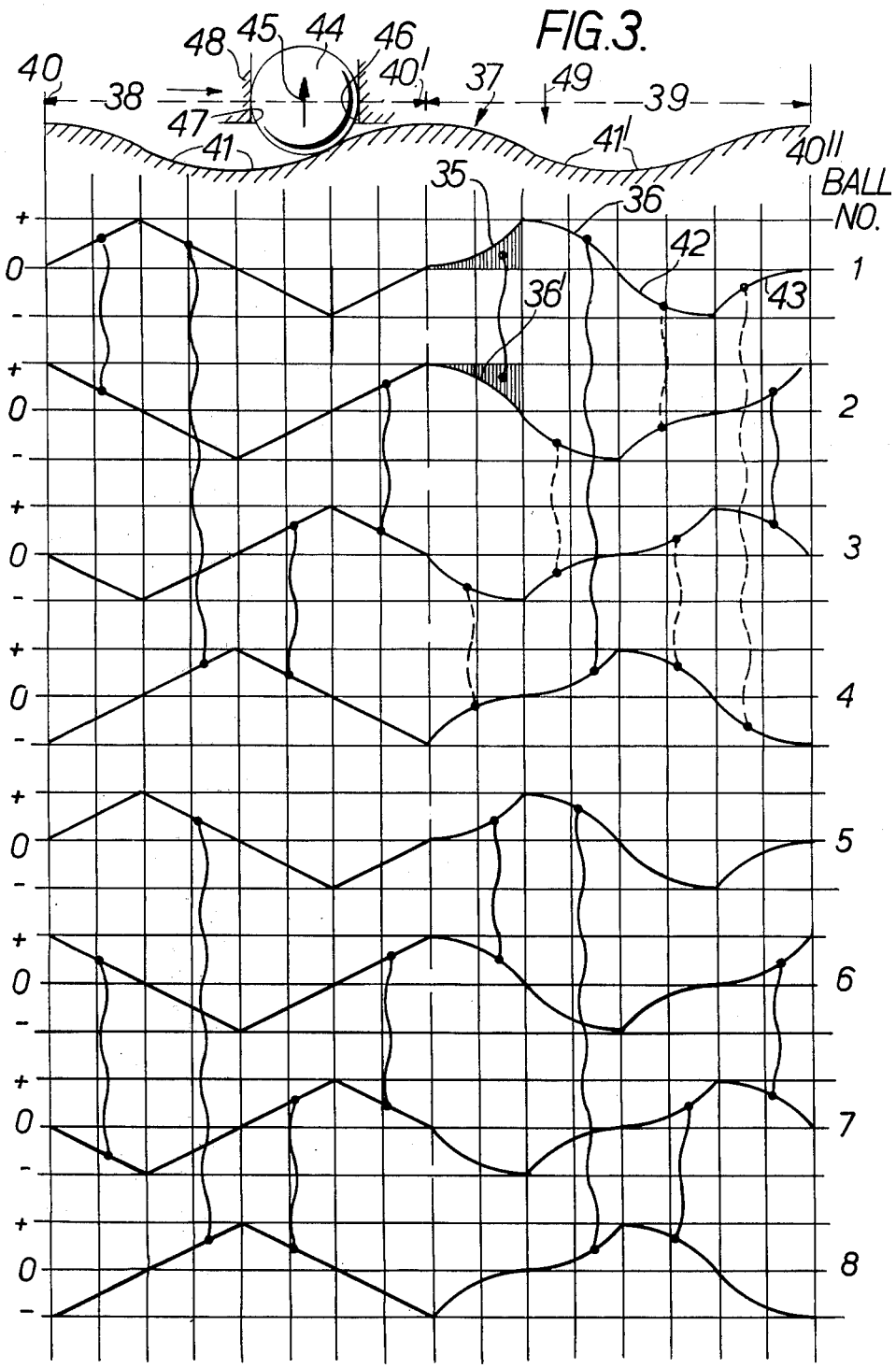
Figure 4:
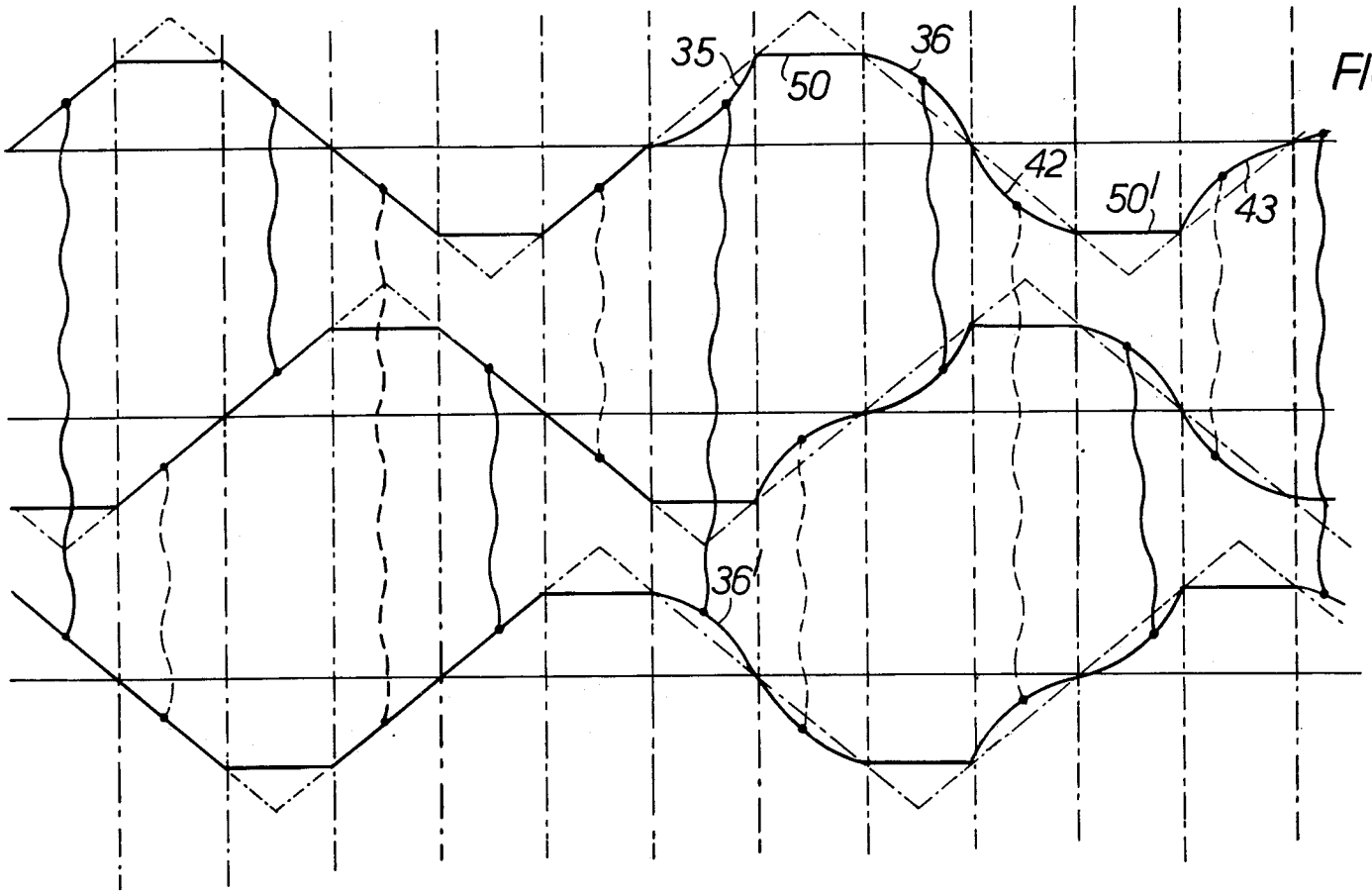
Figure 5:
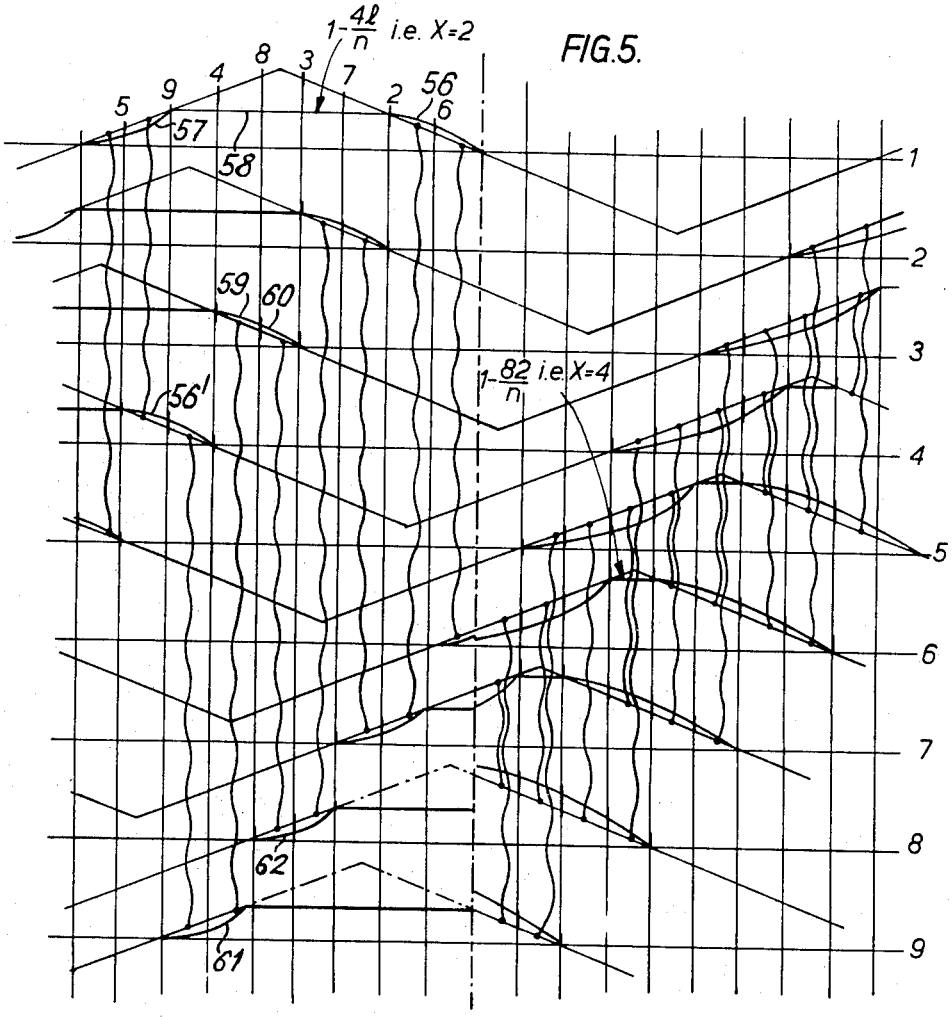
Figure 6:
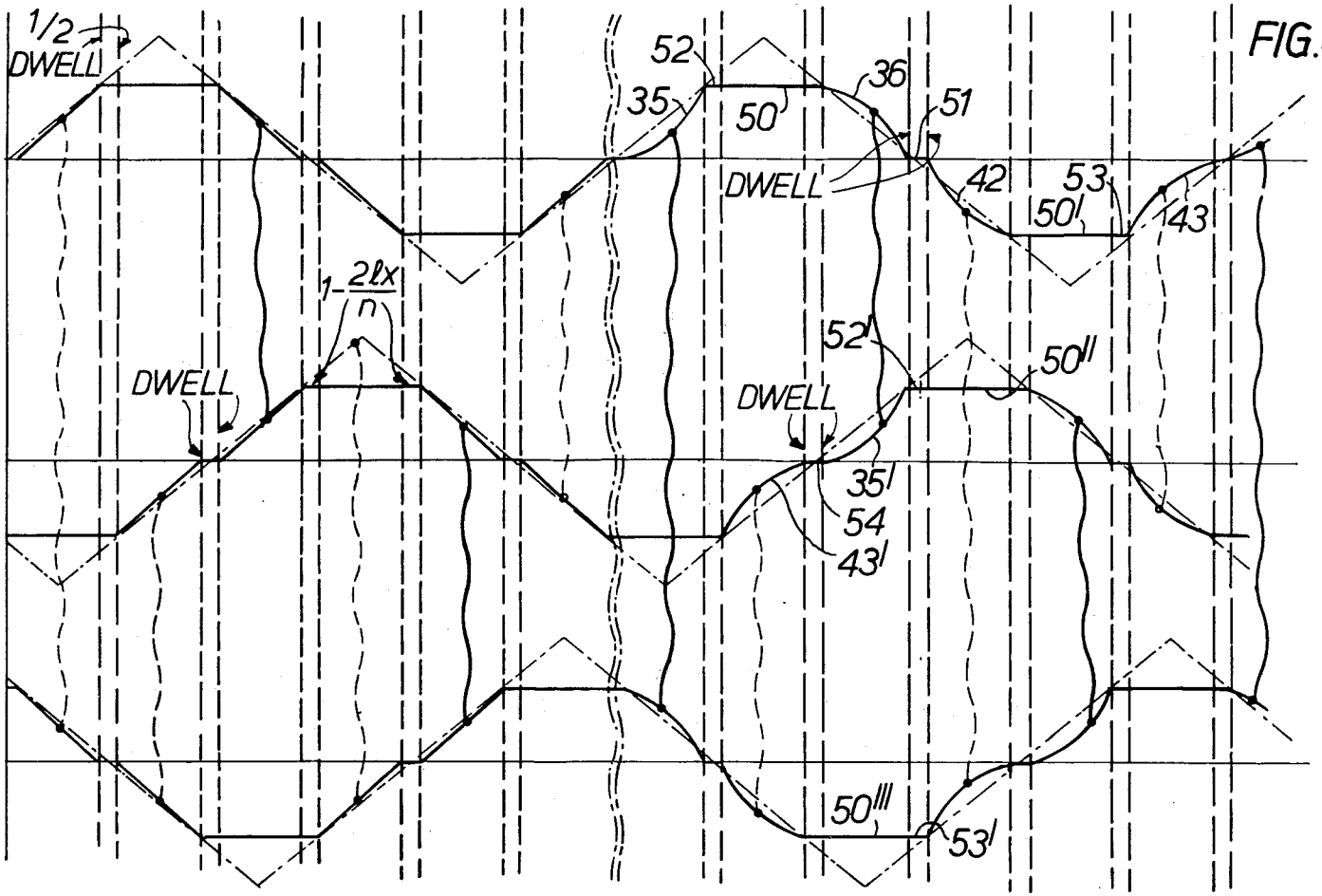
Figure 7:
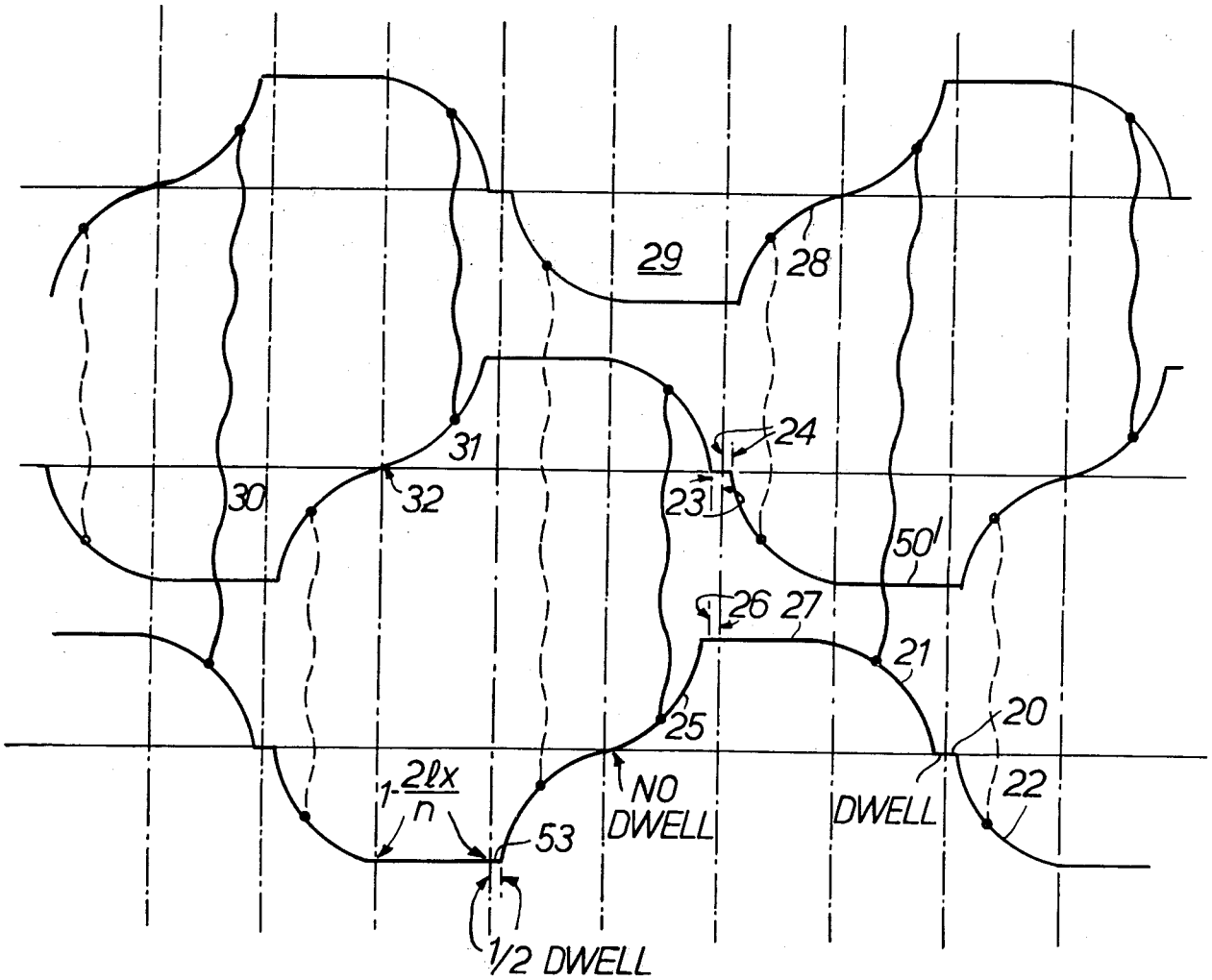

The invention will be more readily understood from the following description of certain embodiments thereof illustrated in the accompanying drawings in which:

FIG. 1A shows piston velocity curves according to the invention,

FIG. 1B shows the locus of the centre of a ball piston following one of the velocity curves of FIG. 1A, and the corresponding cam profile, FIG. 1C shows the locus of the centre of a ball piston following the other of the velocity curves of FIG. 1A, and the corresponding cam profile, FIG. 2 shows a set of piston velocity curves for a machine having 12 balls and 2 complete cam lobes, according to one embodiment of the invention, FIG. 3 shows a set of piston velocity curves for a machine having 8 balls and 2 cam lobes, according to another embodiment of the invention, FIG. 4 shows part of a set of piston velocity curves for a machine having 9 balls and 6 cam lobes, according to another embodiment of the invention, FIG. 5 illustrates, by means of piston velocity curves for a machine having 9 balls and one cam lobe, how the advantages of another embodiment of the invention may be achieved, FIG. 6 shows part of a set of piston velocity curves for a machine having 9 balls and 6 cam lobes, according to an embodiment of the invention in which a dwell is inserted at the dead centre regions of the ball stroke, and FIG. 7 shows part of a set of piston velocity curves for a machine having 9 balls and 6 cam lobes, according to an embodiment of the invention in which a dwell is inserted at one only of the dead centre regions of the ball stroke.

Figure 8:
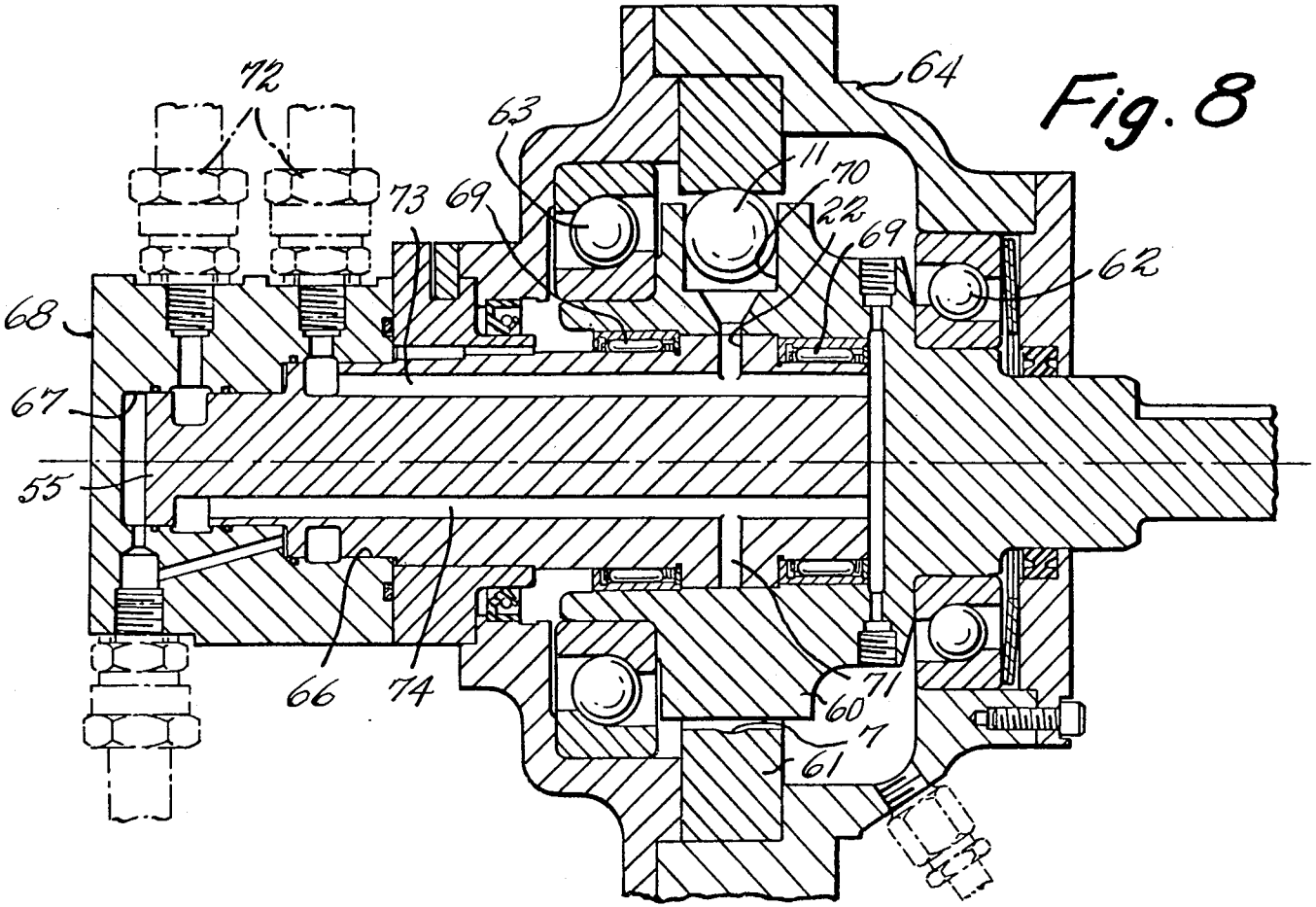

FIG. 8 is a longitudinal cross-section view of a typical hydrostatic piston-and-cylinder machine embodying this invention.

The machine illustrated in FIG. 8 has a rotary cylinder block 60 carrying ball pistons 11 in radial cylinders 12. The balls run on a cam track 7 formed on the internal circumference of a cam ring 61. The cylinder block runs in anti-friction bearings 62, 63 in a rigid housing 64, and a pintle 65 is supported at its outer end in a stepped bore 66, 67 in a port block 68 secured to the housing, and at its inner end in needle bearings 69 in the cylinder block 60. The pintle 65 has the usual system of inlet and exhaust ports 70, 71 which register successively with each cylinder 12 in turn and are connected to the external hydraulic circuit 72 through respective longitudinal ducts 73, 74.

The way in which reversibility and use of the machine either as a pump or a motor are reflected in a piston velocity diagram is illustrated in FIG. 1 of the accompanying drawings which shows the velocity diagram of a single piston traversing a complete lobe of a cam, the contour of the cam being indicated below the velocity diagram and in register therewith. From this it is evident that a gentle slope of the velocity curve at one place where it crosses the zero line in passing from a "negative-going" stroke to a "positive-going" stroke, and a relatively steep slope where it crosses the next following zero crossing point ensures a reduction of the convexity of the cam crest contour for the same machine acting either as a pump or as a motor and for either direction of rotation. The curve for the cam contour is different from the locus of the centre of the ball piston 11 in that it is the envelope of a series of circles, equal in radius to the ball radius, whose centres lie on the said locus. The locus is derived from the velocity curve.

FIG. 1 is in three sections, FIG. 1A, FIG. 1B and FIG. 1C.

FIG. 1A is a velocity diagram showing "positive-going" (2) and "negative-going" (1 and 3) strokes of a piston 11. The full lines show the elementary isosceles triangle characteristic representing constant acceleration followed by constant deceleration, both at the same rate. The dotted lines show (4) a lower rate fordeceleration at the end of a negative-going stroke 1 and acceleration at the beginning of a positive-going stroke 2. This "zero-crossing" point 5 corresponds to the excursion of the ball over the crest 6 of the cam 7, FIG. 1B. The next zero-crossing point 8 is approached by a higher rate of deceleration (9) at the end of the positive-going stroke 2 and at the beginning of the next negative-going stroke 3, and this zero-crossing point 8 corresponds to the excursion of the ball over the trough 10 of the cam 7.

FIG. 1B shows a ball 11, in a cylinder 12 in two positions 5' and 8' corresponding to zero-crossing points 5 and 8 of FIG. 1A. A curve 13 shows the locus of the centre of the ball when its motions are according to the full line curve of FIG. 1A.

The corresponding cam profile is derived by describing a number of circles of radius equal to ball 11 with centres at closely-spaced intervals along locus line 13.

It will be apparent that, though the curvature of the locus line is the same at the crest and trough locations, the envelope of the said circles has a smaller radius of curvature at the crest zone 6 of the cam profile than at the trough zone 10. This is due to the fact that the radius of the ball is subtracted, in the case of the former and added in the case of the latter, to the uniform radius, at these two zones, of the locus curve.

In a motor, the ball being considered as moving from left to right, the highest Hertzian stresses occur between points 14 and 15 of the cam track 7. If the same machine, with the ball moving in the same direction, is acting as a pump the highest Hertzian stresses will occur between points 16 and 14 of the cam track. These positions are of course approximate only and the actual curvatures will depend on the relationship between the radius of the ball and the cam lobe pitch, this in turn being indirectly dependent upon the number of balls $n$ and the number of lobes $m$ of the machine. In a rotary machine with cylinders spaced symmetrically around the complete circumference of a cylinder block and the lobes similarly spaced round an encircling cam, $n$ and $m$ are easily determined. In a segmental rotary machine or a linear cam machine, the cam profile is repeated over a much larger span than that of the cylinder block so that $m$ becomes the number of complete lobes spanned by a linear or angular interval equal to $n$ times the linear or angular ball pitch.

If the motor reverses direction so that the ball moves from right to left the high stress region of the cam becomes the position from 14 to 16, and for this direction of ball motion in the case of a pump it is the cam profile between 15 and 14 which is the high stress region. Looking at FIG. 1A it will be realised that the positive-going and negative-going stroke diagrams have exchanged their roles by reason of this reversal of direction.

To summarise, in relation to FIG. 1A:

With events proceeding from left to right:

for a motor the positive-going stroke triangle 2 represents the power stroke and the negative-going stroke triangles 1 and 3 represent exhaust strokes, for a pump, the negative-going stroke triangles 1 and 3 represent pumping strokes and the positive-going stroke triangle 2 represents an induction stroke, for a motor or a pump reversed in direction so that events proceeding from right to left, these roles of the stroke triangles are reversed.

An important fact to be recognised in considering the significance of velocity diagrams such as those of FIG. 1 is that the slope of the velocity curve, at any point, represents a rate of acceleration or deceleration. Where this is constant (the velocity curve being a straight line), tangents to the corresponding ball centre locus curve at successive points equally spaced along the line of motion to the cylinder block, have equal changes of angle between successive ones of such tangents. When there is a change from acceleration to deceleration, as for instance at the apex of full line triangle 2, the angles of the said tangents start to vary in the opposite sense. This does not necessarily involve a sharp discontinuity of the ball centre locus curve at this point. Any sinuous locus curve must give some more or less abrupt change of direction in the corresponding velocity curve. Another fact to be recognised is that the maximum velocity on the velocity diagram corresponds to the point of maximum slope on the ball centre locus curve, and this is the zone in which the angles of tangents to the locus curve change in sense.

The modified velocity curve represented in FIG. 1A by dotted lines 4 and 9 is reproduced in the correspondingly modified ball centre locus curve 17 and cam profile 18 in FIG. 1C. It will be seen that the flattened velocity curve 4 provides an appreciably larger effective radius of curvature in the region 19 corresponding to the cam lobe crest and that the steepened curve 9 provides an appreciably smaller effective radius of curvature in the region 20 corresponding to the cam lobe trough. When the cam profile corresponding to the dotted line velocity characteristic 4, 9 of FIG. 1A, is traced, it is found that the curvatures of the crest and trough regions are not greatly different, from one another though the effective radius of the crest region is slightly greater than that of the trough region. The mutual convexity of the ball and the cam crest region is thus substantially reduced and the incidence of fatigue failure of the co-acting surfaces is correspondingly reduced.

The fundamental feature of the invention is the inequality between the slope of the velocity curve in the region of zero-crossing point 5 and the slope of the said curve in the region of zero-crossing point 8, the former slope being substantially "flatter" than the latter.

What form the velocity curve takes between these regions is a matter of choice between several alternatives to be described.

FIG. 1A shows in dotted lines the simplest of these alternatives in which the flat slope in the region of zero-crossing point 5 is continued as a constant acceleration until the same amplitude as the apex of full line triangle 2 is reached. This latter triangle is drawn to an arbitrary amplitude scale but is assumed to represent, in the form of the area beneath the curve, the stroke length of a machine under consideration. Any triangle having the same base and the same peak amplitude has the same area and is thus applicable to the same machine.

Since the distance between points 5 and 8, the half-lobe pitch in fact, is determined by the number of lobes, postponment of attainment of peak amplitude gives less time (or ball motion) for deceleration to zero at point 8.

For ball/lobe combinations where $n/1$ is an odd number, 1 being the highest common factor of the ball number $n$, and the lobe number $m$, a simple isosceles triangle velocity diagram will result in a fluctuation of torque, in the case of a motor for a constant supply pressure of the working fluid, and in the case of a pump for a constant delivery pressure, the torque in this case being the mechanical torque applied to drive the pump.

In the case of a linear pump or motor the term "thrust" should, strictly speaking be substituted for the term "torque", but for convenience the term "torque" will be used for both rotary and linear machines.

Copending U.S. application Ser. No. 871,750, now U.S. Pat. No. 3,561,329, discloses methods for eliminating these torque fluctuations by the insertion of a constant velocity phase into the middle of the stroke characteristic so as to render the acceleration phase of one ball coterminous with the deceleration phase of another ball whereby the two oppositely varying ball velocities cancel one another and provide constant torque. Said patent also discloses that in certain ball/lobe combinations where $n/1$ is an even number this same cancellation can be obtained without the insertion of a constant velocity phase.

In the case of a non-isosceles triangle stroke diagram such as that shown by the dotted lines 4 and 9 in FIG. 1A constant torque performance is obtained for certain ball/lobe combinations and certain ratios of the proportion of the stroke occupied by the acceleration phase of an outward stroke of a piston and that occupied by the deceleration phase. In the case of an inward stroke of a piston it is the deceleration phase which is the longer of course. The manner in which this comes about is as follows:

If the said ratio is a whole number a shorter deceleration phase at a high rate is coterminous with parts of acceleration phases, at a low rate, of a number of other balls corresponding to the said ratio, and the former is cancelled out by the aggregate of the latter.

Examples of cases (to which this applies) are as follows:

$n=8$ $m=1$ deceleration/acceleration (outward stroke) ratio=1:3

$n=12$ $m=2$ deceleration/acceleration (outward stroke) ratio=1:2

$n=12$ $m=5$ deceleration/acceleration (outward stroke) ratio=1:2

The generalised criteria for such cases are as follows:

$n/1$ must be an even number

The ratio between the duration of the deceleration phase and the acceleration phase of an outward stroke of a piston (vice versa for an inward stroke) must be $$1:(n/1 - z/z)$$

where $Z$ is an even number, less than $n/1$ and such that $(n/1 - z/z)$ is greater than unity.

FIG. 2 shows a complete velocity diagram for the second of these examples, separate curves for the balls being drawn one below the other and each displaced in phase to the left by comparison with the one above it by an interval corresponding to the ball pitch, shown as $P_b$ in the curves for ball No. 1 and ball No. 2.

In FIG. 2 the curve for ball No. 4 includes reference numerals corresponding to those of FIG. 1A so that the correspondence of the two figures may be made clear.

In the case of ball/lobe combinations not conforming to these criteria there will be a torque fluctuation where a simple triangular velocity diagram obtains.

The class of cases referred to above, where a simple isosceles triangle velocity diagram provides a constant torque characteristic are those cases where the expression:

$$21x/n = 1, \text{ and } n/1 \text{ is an even number.}$$

$x$ being an even number not greater than $n/21$.

If it is required to secure constant torque with such a ball/lobe combination it is possible to do so whilst retaining an acceleration : deceleration stroke proportion ratio of 1 : 1, by sweeping the line 4 of FIG. 1A concavely up to the apex of the full line triangle 2, (at mid-stroke) and thereafter sweeping the deceleration curve convexly downward from the said apex to the point 8, the two curves being complementary so that the acceleration phase of one ball is at all times balanced by the deceleration phase of another ball.

This is illustrated in FIG. 3 which is a complete velocity diagram for a machine having 8 balls and 2 lobes and is drawn to the conventions used for FIG. 2. The left-hand side of the diagram shows how conjugancy between the acceleration of one ball and the deceleration of another ball comes about when isosceles triangle velocity characteristics are used. The right-hand part of the diagram shows how conjugacy is obtained when concave and convex curvilinear velocity characteristics are used for acceleration and deceleration respectively.

Throught FIG. 3 the half-strokes where an acceleration phase is compensated by a deceleration phase are linked together by a wavy line but only the positive-going strokes are treated in this way.

The pairing of the negative half strokes is illustrated at the right-hand side of the diagram but only in respective of the first four balls, by means of wavy dotted lines. The remaining pairings follow a similar pattern.

The relationship between a concave acceleration curve such as 35 and a convex deceleration curve such as 36′ is indicated in respect of balls 1 and 2 at the beginning of the right-hand half of the diagram. The shape of the area beneath the acceleration curve 35 of ball No. 1 must be inverted top to bottom and placed over the curve 36′ of ball No. 2, as indicated in shading lines. The combined flow into the cylinders occupied by these two balls can then be seen to be equal, at all parts of the two respective strokes of these two balls, to the peak flow into the cylinder of a single ball since flow is proportional to velocity.

For this ball/lobe combination the pairings of conjugate strokes is complete within ball Nos. 1 to 4 inclusive. Balls Nos. 5 to 8 inclusive form another group having a similar pattern of stroke pairings within the group. The combined flow into the machine as a whole is therefore equal to the sum of the peak flow into two cylinders, and is constant.

To enable the form of a cam required to produce the motions of ball No. 1 to be more readily envisaged, the profile of the cam 37 is drawn above the velocity curve of ball No. 1. The cam has two lobes 38 and 39, lobe 38 starting (on the left) with a crest 40 proceeding to a trough 41 and thence to a second crest 42, whilst lobe 39 starts with the crest 40′ followed by a trough 41′ and thence to another crest 40″. From 40 to 41 a piston following the cam executes an outwards stroke in its cylinder whereas, when following the cam from 41 to 40′ the piston follows an inwards stroke in its cylinder. A ball piston 44 (respresenting piston No. 1) is shown, in the course of executing an inwards stroke, (arrow 45), into its cylinder 46, which is one of several in a block 48. The surface 47 of ball piston 44 is in contact with the profile of the cam 37.

FIG. 4 (in which the reference numerals of FIG. 3 have been used for equivalent items), is part of a velocity diagram of a 9 ball 6 lobe machine, being a case where $n/1$ is an odd number, necessitating the insertion of a constant velocity phase such as 50 into the middle of the stroke.

The duration of the constant velocity phase is a proportion of the stroke duration given by the expression $1 = (21x/n)$ where $x$ does not exceed $n/21$. Where $n/1$ is an even number, $x$ must be an even number. This is a generalised expression for the length of the constant velocity phase and when $21x/n = 1$ the expression reduces to zero, that is to say a constant torque characteristic is obtained without a constant velocity phase. If $x$ exceeded $n/21$ the value of $21x/n$ would be a minus quantity which is absurd. When $n/1$ is an odd number, $x$ must be less than $n/21$. When $n/1$ is an even number, $x$ may be equal to $n/21$. This of course only applies to the case where the durations of the acceleration phase (such as 35) and the deceleration phase (such as 36) of the strokes are equal to one another.

The way in which these expressions are derived can be more readily appreciated by considering the means by which velocity diagrams such as FIGS. 2 and 3 are most easily constructed. A suitable horizontal distance is chosen for dividing up into $m$ lobe interfals and $2m$ half-lobe intervals. Stroke triangles, alternatively positive-going and negative-going, are drawn in the half-lobe intervals, for the top velocity curve, for ball No. 1. The same distance is then divided by the number of balls $n$ to give the ball pitch to the same scale as the lobe pitch and the velocity curves for the remaining balls are drawn one below the other, similar to the curve for ball No. 1, but each laterally displaced in relation to the one above it by an interval equal to the ball pitch. For an acceleration phase of one ball to be conjugate with the deceleration phase of another ball both must begin and end at the same instants. The instants of the beginning of an acceleration and the end of a deceleration are fixed by the geometry of the machine, at the centers of the crests and troughs respectively of the cam lobes, that is to say at the zero-crossing points of the velocity curves.

If vertical lines are drawn the full height of the diagram passing through all zero-crossing points of all the curves it will be found that these lines are separated from one another by a horizontal distance equal to $1/n$ of the stroke duration where$n/1$ is an odd number and $21/n$ of the stroke duration where $n/1$ is an even number. In the latter case, a vertical line intersects the appex of each isosceles triangle stroke diagram indicating that constant torque can be obtained with no constant velocity phase. In some $n/1$ = even cases, it will be found that the apex of each stroke triangle is flanked by one or more pairs of vertical lines indicating that constant torque can be obtained with a constant velocity phase determined by the points of intersection of the vertical lines of a pair, with the sides of the stroke triangle, and where there is more than one such pair (e.g. in a 12 ball, 5 lobe machine) there is a choice between two alternative lengths for the constant velocity phase. The intervals $1/n$ (for $n/1$ = odd) and $21/n$ (where $n/1$ = even) indicate the shortest lengths for the velocity change sections of the stroke, which are equal to one another, (acceleration to deceleration). The maximum length of the constant velocity phase is the difference between the stroke length and the sum of two such velocity-change sections, i.e. $1 - (21/n)$ where $n/1$ = odd and $1 = (41/n)$ where $n/1$ is even. Where there are alternative lengths for the c.v. phase, the velocity-change sections each increase in integral multiples of $1/n$ where $n/1$ = odd and $21/n$ where $n/1$ = even. Thus the expression for the length of the constant velocity phase may be generalised to $1 - (21x/n)$ and $x$ can be 1 for the $n/1$ = odd case, but must be an even number and therefore at least 2, for the $n/1$ = even case. This last stipulation reflects the fact that the velocity change parts of the stroke are multiples of $21/n$ for $n/1$ = even cases.

The proff that $x$ must not exceed $n/21$ is as follows. It is axiomatic that the term $21x/n$ must not exceed but may be equal to unity. If it is equal to unity $21/n \times n/21 = 1$, (substituting $n/21$ for $x$). If $x$ were to exceed $n/21$, $21x/n$ would exceed unity.

It must be realised that not all ball number/lobe number combinations can be made to yield a constant total displacement for constant speed characteristic because, with some combinations there is no overlap at all between an acceleration phase of one piston and the deceleration phase of another piston.

Such combinations can be detected by the fact that they infrings one or more of the rules above set out for determining the length of the constant velocity phase. For instance, take the combination of four pistons and two lobes:

$n = 4, m = 2, l = 2$ $n/1 = 4/2$ = even, therefore $x$ must be even.

$1 - (21x/n)$, with the lowest permitted value for $x$, namely $2 = 1 - (2 \times 2 \times 2)/4 = 1 - 2 = -1$, which is absurd.

Similarly $x$ must not exceed $n/21 = 4/4 = 1$, yet $x$ must be an even number which is also absurd.

The ball No./lobe No. combination 4/2 therefore cannot be made to give constant torque.

The statements above about procuring "constant torque" characteristics by the insertion of a constant velocity phase, which may be zero, must be regarded as qualified by the three immediately preceding paragraphs.

FIG. 4 is a part of a diagram drawn according to the above principles of construction, relating to a nine ball, six lobe machine and is to an enlarged scale. The left-hand part of the diagram shows constant rate accelerations and decelerations for the balls and indicates the pairings of these phases of the strokes of pairs of balls. The right-hand side of the drawing illustrates curvilinear velocity-change characteristics comparable with those of the right-hand side of FIG. 3 but for a case where a constant velocity phase has to be inserted into the stroke to preserve conjugacy between velocity change parts of strokes. The reference numerals used in FIG. 3 are repeated in FIG. 4 for corresponding items.

This particular ball No./lobe No. combination provides three groups of three balls each, within each of which groups pairings of conjugate velocity change phases of strokes is complete.

The expressions determining the lengths of the various parts of the strokes are as follows:

$n = 9, m = 6, l = 3, n/1 = 9/3 = 3$ = odd

Distance between vertical lines drawn through zero-crossing points $= 1/n = 3/9 = 1/3$ of the stroke length.

Length of constant velocity phase $= 1 - 21x/n = 1 - (2 \times 3 \times X)/9$.

Maximum value for $x = n/21 = 9/6 = 1.5$. Therefore $x$ can only have the single value of unity without exceeding this;

$1 - 21x/n = 1 - 6/9 = 1 - \frac{2}{3} = \frac{1}{3}$rd. of the stroke length.

There is a wide choice of permissible curvatures for the characteristics of the curvilinear velocity-change parts of the stroke as illustrated in the right-hand halves of FIGS. 3 and 4.

One preferred design procedure is to select from cam shapes which give the position a velocity characteristic, during an acceleration part of a working stroke where a convex part of the cam profile is being traversed:

$$V = A\theta^a$$

where $V$ is the radial velocity of the center of the ball $A$ is a constant which is proportional to the stroke of the ball and the number of lobes on the cam $\theta$ is the instantaneous angle of rotation of the cylinder block from a given datum position in which a ball under consideration is at the cam crest dead center position.

The velocity of the ball during the deceleration sector of such a stroke, where a concave part of the cam profile is being traversed, is made complementary to the ball velocity obtained during the said acceleration sector.

As the index of $\theta$ (i.e. $a$) is increased, the point of minimum radius of the convex part of the cam profile shifts from the immediate vicinity of the cam crest region to a position a little further along the cam profile. For any given configuration for the machine (i.e. number of balls, number of lobes, cam track inner dead center radius and outer dead center radius) there will be a value of $a$ which makes the minimum radius of the cam track a maximum.

A convenient procedure, in the case of a rotary machine, is to write a programme for a computer containing the relative constants for ball size, stroke, means pitch circle radius of balls, dwell (if any) and number of balls and lobes. The computer will then compute the co-ordinates and the instantaneous values of the radius of curvature of the path of the center of a ball for various values of $\theta$ over the convex parts of the said path.

The computer provides a set of solutions for a set of different values of the index ($a$) of $\theta$ and it may be desirable to use a fractional index to achieve the optimum solution.

Since these solutions relate to the path of the ball center the values for instantaneous radius of curvature must be reduced by subtracting the ball radius, to obtain the radii of curvature of the actual cam profile.

In choosing the optimum solution account is taken of the fact that the normal loading of the ball against the cam, for any given pressure acting on the ball, increases with the angle of attack of the ball against the cam so that the stresses for a given convexity of the cam increase as the point of minimum radius of curvature recedes from the apex of the cam crest; thus in theory, an increase of the minimum radius of curvature of the convex part of the cam profile might not reduce the stresses at all if the point of minimum radius of curvature was moved too far away from the crest apex, indeed it might even increase the stresses; in practice however the maximum angle of attack is not likely to be great enough for the increase in loading with increasing angle of attack to be significant and it is legitimate to disregard it and design for maximum value of minimum radius of convex curvature.

An alternative ball velocity characteristic to that given by the expression $V = A\theta^a$ above, is a more general polynomial, e.g.:

$$V = A\theta^a + B\theta^{a-1} + C\theta^{a-2}$$

where $A$, $B$, $C$ etc., are selected constants. With such a procedure a polynomial can be selected which gives a contact stress between the ball and the cam surface which is constant over convex parts of the cam profile.

These are of course refined design procedures; in practice somewhat cruder solutions may be adequate, for instance an optimised velocity characteristic may be approximated by two or more straight lines.

Since equal duration acceleration and deceleration periods demand curved characteristics which must be complementary to provide constant torque, high values of the index of $\theta$ in expression such as those above, involve small radii of curvature for concave parts of the cam profile. This could lead to the cam trough radius of curvature being less than the ball radius. Increase of the index of $\theta$ must stop short of this point.

It will be noticed, in comparing the elementary stroke triangles on the left in FIG. 4, (the truncated tops of which are shown in dotted lines), that the insertion of the constant velocity phase reduces the area beneath the curve. If the original elementary stroke triangle had been drawn to scale so that its area truly represented the physical piston stroke length of a particular machine under design, the area of the final curve with a constant velocity phase inserted must have its peak velocity adjusted until the area of the trapezium is equal to that of the elementary stroke triangle, or an allowance can be made for this by increasing the peak velocity of the elementary stroke triangle by an appropriate amount which can readily be calculated. Assuming that the latter has been done then the adoption of curvilinear characteristics for the velocity-change sections of the stroke, according to the right-hand side of FIG. 4, does not alter the area beneath the curve as compared with the trapezia on the left of the Figure.

The same applies mutatis mutandis to FIG. 3.

It is necessary to make a proviso about the applicability of the generalised expression $1 - (21x/n)$ for the length of the constant velocity phase to the case where other than constant rate characteristics for the whole of each velocity-change part of a stroke, are adopted.

In applying this expression to the cases where $n/1$ is an odd number $x$ can have values of 1, 2, 3, 4 . . . etc. so long as it does not exceed $n/21$. When constant rate acceleration and deceleration characteristics are adopted, alternate values (i.e. 2, 4, 6 . . . ) result in a pattern of pairing of conjugate velocity-change phases of the strokes of the balls which is different from that shown in the left-hand part of FIG. 4 in that different parts of an acceleration period of one ball are paired with parts of the deceleration strokes of different balls and vice versa. This is illustrated in FIG. 5 in respect of a nine ball/one lobe machine, which shows the pattern of conjugacy of velocity-change phases as between different balls, both in respect of the basic isosceles triangle stroke diagram modified by insertion of a constant velocity phase and the imperfect conjugacy where the velocity-change phases of the strokes are modified as described in relation to FIGS. 3 and 4.

Thus when other than constant rate characteristics are adopted for the whole of each velocity-change part of a stroke, this pattern of pairing does not given a constant torque characteristic because, for instance, the first part, e.g. 56, of a deceleration phase, does not have the same curvature or slope as the last part, e.g. 57, of an acceleration phase and is at a different level from the corresponding straight-line velocity-change phase, e.g. 58. The two parts are therefore not mutually complementary. When $n/1$ is an odd number therefore, alternate values of $x$, i.e. 2, 4, 6 . . . etc. must be excluded, if constant torque is required. The velocity curves on the left in FIG. 5 would result in a fluctuation of about 7 percent in the torque of a motor supplied at a constant pressure.

In the case where $n/1$ is even, the possible values of $x$ where constant rate velocity-change characteristics are adopted, are 2, 4, 6, 8, 10 . . . etc., (which do not exceed $n/21$). When other than constant rate characteristics for the whole of each velocity change phase of a stroke are adopted, again alternate values of $x$, i.e. 4, 8 . . . etc., must for the same reason be excluded, if constant torque is required.

It is frequently desirable to introduce a small dwell section into the cam profile at both dead center points so that tolerances in the location of ports leading to the cylinders and ports in the valve member with which they co-operate, may be relaxed. If this is done the validity of the vertical lines through zero-crossing points on the velocity diagram, as anchor points in determining the timing of the end of an acceleration phase and the beginning of a deceleration phase is lost. If the dwell periods are symmetrically disposed about the respective zero-crossing points of the velocity diagram and two vertical lines are drawn through the beginning and end of each dwell period, replacing the vertical lines through the zero-crossing points, these lines, where they intersect the sides of stroke triangles, establish new timing points for the ends of acceleration phases and the beginnings of deceleration phases. The result is to extend any constant velocity phase demanded by the ball No./lobe No. combination by half the amount of the dwell, at each end and where the said combination does not demand a constant velocity phase, (the value of the expression $1 - (21x/n)$ being zero) then a constant velocity phase of the length of the two half-dwell periods must be introduced.

This is illustrated in FIG. 6, which is self-explanatory, and in which the reference numerals of FIGS. 3 and 4 have been repeated for corresponding items.

A dwell at the trough dead center position is instanced at 51 and a dwell at the crest dead centre position is instanced at 54. The first half of a trough dead center dwell such as 51 is covered by the advancement of the beginning of the constant velocity phase of the outward stroke of a piston in its cylinder as shown at 52', for the constant velocity phase 50''. The second half of a trough dead centre dwell such as 51 is covered by the delay, as shown at 53', of the end of the constant velocity phase such as 50''', of an inwards stroke of a piston in its cylinder.

The first half of a crest dead center dwell such as 54, is covered by the advancement of the beginning of the constant velocity phase such as 50'''of an inwards stroke of a piston in its cylinder. The second half of a creast dead centre dwell such as 54, is covered by the delay of the end of the constant velocity phase, such as 50, of an outwards stroke of a piston in its cylinder.

When the cam crest convexity has been reduced by the application of the invention, it will frequently be possible to omit the dwell at the cam crest dead centre because the velocity of the ball, for a length of the cam crest equal to the dwell required to enable valve tolerances to be relaxed, will be sufficiently low to be near enough to a dwell condition for all practical purposes.

In a machine such as that illustrated by FIG. 4, where a constant velocity phase is inserted into the stroke to ensure constant torque, a dwell at the cam trough dead center only is compatible with constant torque performance if the ball velocity characteristics shown in FIG. 7 are followed.

The dwell such as 20 is inserted between the end of a deceleration phase 21 of a positive-going stroke and the beginning of an acceleration phase 22 of a negative-going stroke, that is to say at the centre of a trough of the cam profile. This may be considered as consisting of two half dwells 23 and 24 shown for convenience in the curve of another ball. It becomes necessary to shorten acceleration phases of positive-going strokes, such as 25 by an amount 26 equal to the half-dwell 23, and to advance the start of the succeeding constant velocity phase such as 27 by the period 26 by which the acceleration phase 25 is shortened. The half-dwell period 24 shortens the acceleration phase 28 of negative-going strokes such as 29 retarding the beginning of that phase by an amount equal to half-dwell 24, which necessitates the lengthening of the constant velocity phase of stroke 29 by that amount.

The end of a negative-going stroke such as 30 and the coincident beginning of a positive-going stroke such as 31 take place at a cam crest dead centre and no dwell is inserted at this point (32). Thus only one end of each constant velocity phase is lengthened by the amount of a half-dwell. Constant torque performance is obtained.

In the case of ball No./lobe No. combinations for which constant torque characteristics are obtainable without a constant velocity phase when no dwell is provided, the insertion of a dwell at the cam trough regions only, necessitates the insertion of a constant velocity phase of duration equal to the half-dwell, (such as 23, 24 in FIG. 7).

It must again be stressed that the invention is not confined to examples where constant torque is provided though in practice the latter would be chosen if it could be provided without extra cost. There are applications, such as the motor element of a pump/motor hydrostatic vehicle transmission system, where a certain amount of ripple in the torque output of the motor may be of little consequence. In such cases constant rate acceleration and deceleration phases of unequal length may be chosen, even in the case of ball No./lobe No. combinations which do not provide constant torque according to the embodiment illustrated in FIG. 2 and the other examples quoted above.

We claim:

1. A hydrostatic piston-and-cylinder machine having an array of cylinders and a piston for, and movable in, each such cylinder, a sinuous cam track, and cam-following surfaces of or carried by the pistons engaging the cam track whereby the pistons move to and fro along the axes of their cylinders on movement of the cylinder array along the length of the cam track characterized in that the cam track is so shaped as to impose on the piston for an outward stroke of said piston, commencing with the associated cam follower surface engaging the center of a crest of the cam, an initial phase of acceleration starting at a relatively low rate of velocity change and during which the magnitude of the function of piston velocity plotted against time rises concavely, and a terminal phase of deceleration concluding with a relatively high rate of velocity change and during which the magnitude of the said piston velocity function falls convexly and further characterized in that each inward stroke of a piston, terminating with the associated cam follower surface engaging the center of a crest of the cam, has an initial phase of acceleration for said piston starting at a relatively high rate of change of velocity in which the magnitude of the said piston velocity function value rises convexly and a terminal phase of deceleration concluding with a relatively low rate of change of velocity, and in which the magnitude of the said piston velocity function value falls concavely and in which the initial phase of acceleration in respect of an outward stroke is equal in duration to the terminal phase of deceleration in respect of an inward stroke and the terminal phase of deceleration in respect of an outward stroke is equal to the initial phase of acceleration in respect of an inward stroke, the initial acceleration phase of the stroke of one piston in a given direction, i.e. either inwards or outwards of the cylinder, is coincident with the terminal deceleration phase of the stroke in the same direction of another piston, the change of velocity of the two pistons at any instant during the two coincident phases, being equal in rate but opposite in sense whereby the aggregate of displacement of such two pistons does not vary during such coincident phases.

2. A hydrostatic piston-and-cylinder machine having an array of cylinders and a corresponding array of pistons one such piston being for, and movable in, each such cylinder, a sinuous cam track, cam-following surfaces of, or carried by the pistons engaging the cam track whereby the pistons move to and fro along the axes of their cylinders on movement of the cylinder array along the length of the cam track characterized in that the cam track is so shaped as to impose on the piston for an outward stroke of said piston, commencing with the associated cam follower surface engaging the center of a crest of the cam, an initial phase of acceleration in which the rate of velocity changes does not fall in magnitude during the phase and starting at a relatively low rate of velocity change and a terminal phase of deceleration in which the rate of change of velocity does not fall in magnitude during the phase and concluding with a relatively high rate of velocity change and further characterized that each inwards stroke of a piston, terminating with the associated cam follower surface engaging the center of a crest of the cam, has an initial phase of acceleration for said piston in which the rate of velocity change does not grow in magnitude during the phase and starting at a relatively high rate of change of velocity, and a terminal rate of deceleration in which the rate of change of velocity does not grow in magnitude during the phase and concluding with a relatively low rate change in velocity, in which the initial acceleration phases of the strokes of a first group of the pistons comprised within said piston array in a given direction, i.e. either inwards or outwards of the cylinder, are contemporaneous with the terminal deceleration phases of the strokes in the same direction of a second group of pistons comprising the remainder of the piston array the change of velocity of the two said groups of pistons at any instant during the two contemporaneous phases being equal in rate but opposite in sense whereby the aggregate rate of displacement of such two groups of pistons does not vary during such contemporaneous phases.

3. A hydrostatic piston-and-cylinder machine having an array of cylinders and a piston for, and movable in, each such cylinder, a sinuous cam track, cam-following surfaces of, or carried by the pistons engaging the cam track whereby the pistons move to and fro along the axes of their cylinders on movement of the cylinder array along the length of the cam track characterized in that the cam is so shaped as to impose on the piston for an outward stroke of said piston, commencing with the associated cam follower surface engaging the center of a crest of the cam, an initial phase of acceleration starting at a relatively low rate of velocity change and a terminal phase of deceleration concluding with a relatively high rate of velocity change and further characterized in that each inward stroke of a piston, terminating with the associated cam follower surface engaging the center of a crest of the cam, has an initial phase of acceleration for said piston starting at a relatively high rate of change of velocity and a terminal phase of deceleration concluding with a relatively low rate of change of velocity, the initial phase of acceleration in respect of an outward stroke is equal in duration to the terminal phase of deceleration in respect of an inward stroke and the terminal phase of deceleration in respect of an outward stroke is equal to the initial phase of acceleration in respect of an inward stroke, the initial acceleration phase of the stroke of one piston in a given direction, i.e. either inwards or outwards of the cylinder, is coincident with the terminal deceleration phase of the stroke in the same direction of another piston, the change of velocity of the two pistons at any instant during the two coincident phases, being equal in rate but opposite in sense whereby the aggregate rate of displacement of such two pistons does not vary during such coincident phases, in each stroke of a piston the said initial phase and the said terminal phase being separated by a constant velocity phase occupying a proportion of the duration of the stroke given by the expression $1 - (21x/n)$ where $n$ is the number of cylinders, 1 is the highest common factor of $n$ and the number $m$ of complete lobes of the cam track spanned by $n$ times the distance along the cam track between points of intersection therewith, of the axes of adjacent cylinders, multiplied by the number of cylinders, $x$ being a whole number which must be an odd number when $n/1$ is odd and must be an even number in the series of alternate even numbers 2, 6, 10, 14 . . . when $n/1$ is even and which must not exceed $n/21$, including the case where $1 - (21x/n) = 0$.

4. A hydrostatic piston-and-cylinder machine having an array of cylinders and a piston for, and movable in, each such cylinder, valve means communicating with said cylinders as the pistons move to and fro, a sinuous cam track, cam-following surfaces of, or carried by the pistons engaging the cam track whereby the pistons move to and fro along the axes of their cylinders on movement of the cylinder array along the length of the cam track characterized in that the cam track is so shaped as to impose on the piston for an outward stroke of said piston, commencing with the associated cam follower surface engaging the center of a crest of the cam, an initial phase of acceleration starting at a relatively low rate of velocity change and a terminal phase of deceleration concluding with a relatively high rate of velocity change, characterized in that each inward stroke of a piston, terminating with the associated cam follower surface engaging the center of a crest of the cam has an initial phase of acceleration for said piston starting at a relatively high rate of change of velocity and a terminal phase of deceleration concluding with a relatively low rate of change of velocity, the initial phase of acceleration in respect of an outward stroke is equal in duration to the terminal phase of deceleration in respect of an inward stroke and the terminal phase of deceleration in respect of an outward stroke is equal in duration to the initial phase of acceleration in respect of an inward stroke, and further characterized in that, on each outward stroke of a piston, the associated cam follower surface has a phase of constant velocity between said phase of acceleration and said phase of deceleration wherein said cam follower surface travels at the maximum velocity obtained during said acceleration phase.

5. A machine according to claim 4, wherein the configuration of the cam surface, the configuration of the cam follower surfaces, and the number of pistons is such that the total torque output of the machine is constant during movement of the cylinder array along the length of the cam track.

6. A machine according to claim 4, characterized in that the cam track is so shaped that the associated cam follower surface has at least one dwell phase of zero velocity in the direction of the associated piston during its travel between adjacent crests of the cam.

7. A machine according to claim 6, wherein the configuration of the cam surface, the configuration of the cam follower surfaces, and the number of pistons is such that the total torque output of the machine is constant during movement of the cylinder array along the length of the cam track.

* * * * *

UNITED STATES PATENT OFFICE

CERTIFICATE OF CORRECTION

Patent No. 4,048,906 Dated September 20, 1977

Inventor(s) Donald Firth and Sinclair Upton Cunningham

It is certified that error appears in the above-identified patent and that said Letters Patent are hereby corrected as shown below:

Column 4, line 16, there should be a space after "for" and before "decelera-".

Column 6, line 65, "1:(n/1 -z/z)" should read -- 1:(n/1 - z)/z --.

Column 6, line 67, "(n/1 - z/z)" should read -- 1:(n/1 - z)/z --.

Column 7, line 33, correct the spelling of "conjugacy".

line 40, "Throught" should be --Throughout--.

lines 45 and 46, "respective" should be --respect of--.

Column 8, line 41, correct the spelling of "intervals"

line 62, there should be a space between "where" and "n/1".

UNITED STATES PATENT OFFICE

CERTIFICATE OF CORRECTION

Patent No. 4,048,906 Dated September 20, 1977

Inventor(s) Donald Firth and Sinclair Upton Cunningham

It is certified that error appears in the above-identified patent and that said Letters Patent are hereby corrected as shown below:

(continued)

Column 9, line 25, correct the spelling of "proof".

Column 10, line 52, "means" should be --mean--.

Column 13, line 8, "creast" should be --crest--.

Column 14, line 54 (Claim 2), "changes" should be --change--.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*